United States Patent [19]

Gemmel et al.

[11] 4,216,013

[45] Aug. 5, 1980

[54] DUCTILE FERRITIC STEELS AND THEIR USE FOR METALLIC ARTICLES, ESPECIALLY WELDED CONSTRUCTIONS

[76] Inventors: Göran Gemmel, Karlsrogatan 12A; Christer Åslund, Juhlingatan 21, both of S-644 00 Torshälla; Barry Solly, Regnbaagsvägen 9, S-773 00 Fagersta, all of Sweden

[21] Appl. No.: 947,332

[22] Filed: Sep. 28, 1978

Related U.S. Application Data

[63] Continuation of Ser. No. 801,374, May 27, 1977, abandoned.

[30] Foreign Application Priority Data

May 28, 1976 [DE] Fed. Rep. of Germany ..... 2624117

[51] Int. Cl.[2] ..... B32B 15/18; C22C 38/42

[52] U.S. Cl. ..... 75/125; 75/128 G; 75/128 N; 75/128 T; 75/128 W

[58] Field of Search ..... 75/125, 128 T, 128 N, 75/128 W, 128 G

[56] References Cited

U.S. PATENT DOCUMENTS

| | | | |
|---|---|---|---|
| 3,258,370 | 6/1966 | Fhoreen et al. | 75/128 G |
| 3,677,744 | 7/1972 | Yamamura et al. | 75/128 T |
| 3,837,847 | 9/1974 | Bieber | 78/128 T |
| 3,856,515 | 12/1974 | Barandis et al. | 75/125 |
| 3,865,644 | 2/1975 | Hellner et al. | 75/128 G |
| 4,055,448 | 10/1977 | Fugikura et al. | 75/128 G |
| 4,119,765 | 10/1978 | Pinnow et al. | 148/37 |

FOREIGN PATENT DOCUMENTS

| | | | |
|---|---|---|---|
| 2417632 | 11/1974 | Fed. Rep. of Germany | 75/128 W |
| 47-8689 | 3/1972 | Japan | 75/125 |

*Primary Examiner*—L. Dewayne Rutledge
*Assistant Examiner*—Upendra Roy

[57] ABSTRACT

Ferritic, stabilized, stainless and corrosion-resistant chromium-molybdenum steels with a carbon content of from 0.01 to 0.025%, a nitrogen content of from 0.005 to 0.025%, a chromium content of from 20.0 to 30.0%, a molybdenum content of from 3.0 to 5.0%, manganese and silicon contents of from 0.02 to 1.0% in each case and vanadium, tungsten, cobalt and aluminum contents of at most 0.25% in each case and also with a nickel content of from 3.2 to 4.8%, a copper content of from 0.1 to 1.0%, a titanium content of from 0.2 to 0.7% and/or a niobium content of from 0.2 to 1.0%, the rest being iron with the usual impurities, alloying additions of boron and/or zirconium being permitted in quantities which correspond to the prior art.

2 Claims, 4 Drawing Figures

Figure 1:
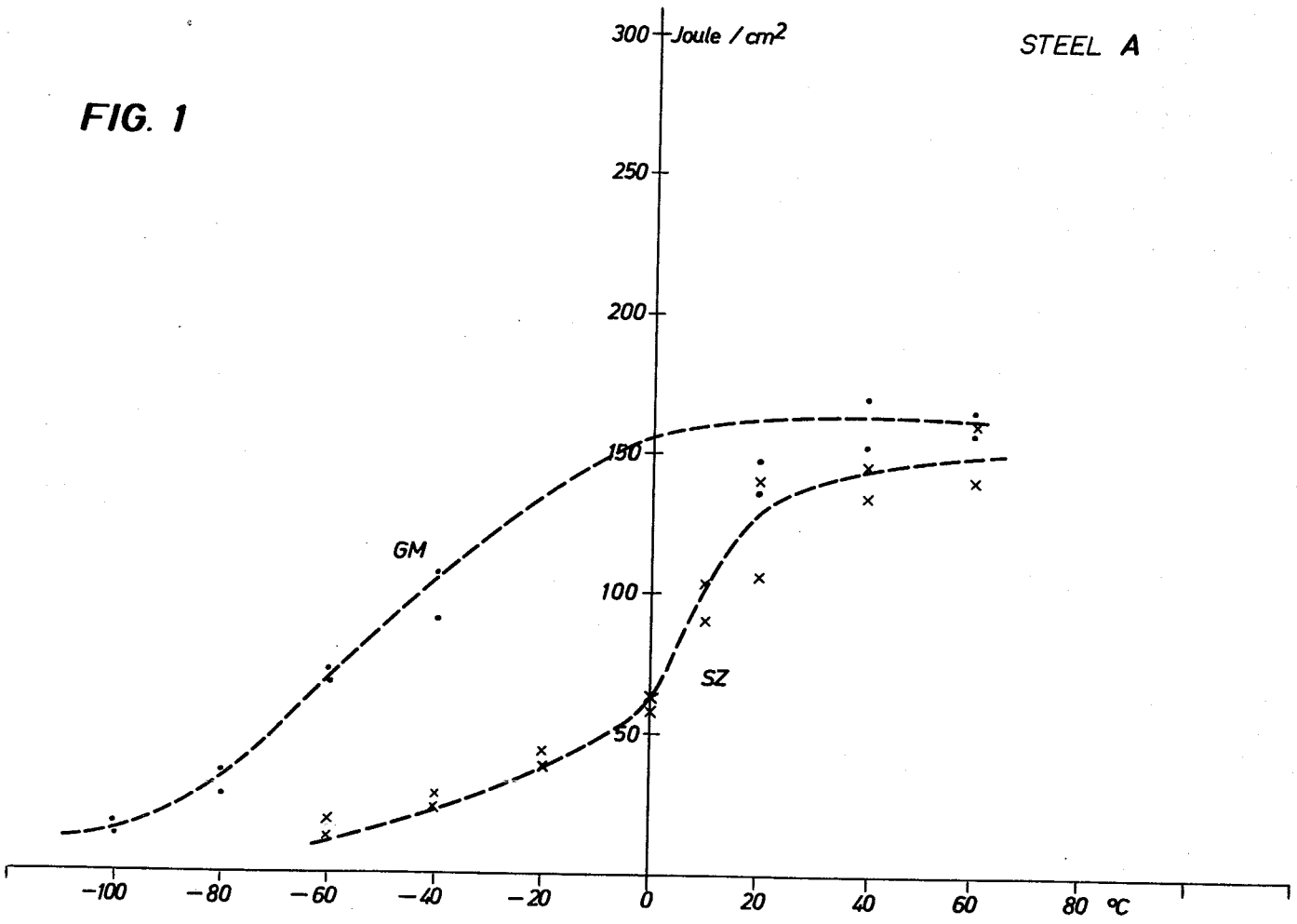

DUCTILE FERRITIC STEELS AND THEIR USE FOR METALLIC ARTICLES, ESPECIALLY WELDED CONSTRUCTIONS

This is a continuation of application Ser. No. 801,374, filed May 27, 1977, now abandoned.

In recent years, ferritic chromium-molybdenum steels have been the subject of exhaustive investigations in order to ascertain the essence and structural relationship of the deficiencies attending these steels in relation to austenitic Cr-Ni steels so that they may be minimised or eliminated which is of particular economic significance in view of the advantages which these steels have over the austenitic steels among others. Above all, the knowledge of the influence of the inclusion elements carbon and nitrogen has led to new metallurgical processes by which the contents of these elements can be reduced to below the hitherto usual levels. However, this involves the use of metallurgical techniques and installations which use up a large part of the desired economy. Also, the results obtained have been unsatisfactory, particularly in regard to the position of the transition temperature, i.e. the temperature at which the steel changes abruptly from the ductile state to the brittle state.

The use of stabilising elements for fixing the C- and $N_2$-contents at the low contents of these elements of less than 0.03% led to additions which, for Ti for example, no longer correspond to the stoichiometry of 1:4, but instead had to be increased to 1:15 which gave contents that adversely affects the property values of the steels. In general, C and $N_2$ contents below 0.015% are now proposed, Si contents of 0–3%, manganese contents of 0–1%, nickel contents of 0–5% and copper contents of 0–2% being permitted in certain cases because no influence on the properties of these steels was associated with these elements in the ranges indicated, as is apparent from the mere fact that these elements need not be present. The position of the transition temperature is particularly important for welding which is of course necessary in those cases where these steels are used for the manufacture of industrial products. The abovementioned steels which, in the unwelded state, show ductility values of an acceptable nature become brittle in the weld seam and in the zones adjacent the weld seam.

Investigations which form the basis of the present invention have now produced the surprising and unexpected result that stabilized ferritic chromium-molybdenum steels can have transition temperatures far below room temperature, particularly in the weld seam and in the zones directly adjacent the weld seam, providing the steels known per se have added to them quantities of nickel and copper which lie within a certain limited range, the C and $N_2$ contents also being kept within a certain percentage range which surprisingly lies at relatively high contents, and finally quantities of Ti or Nb which are below the usual equivalents, but amount to at least 0.2%, in addition to which the Ti content may amount to 4 times the $(C+N_2)$-content and the Nb content to 8 times the $(C+N_2)$-content, their maximum levels amounting to 0.7% and 1.0%, respectively. The invention is characterised as stated in the claims.

The remarkable and completely unexpected feature of the invention is that, for relatively high $(C+N_2)$-contents, relatively large amounts of nickel and, to a lesser extent, of copper have to be added to obtain high ductility values coupled with the same high resistance to corrosion at room temperature and at temperatures below room temperature, particularly in the welding zone.

In order to demonstrate the surprising and unexpected effect of adding nickel in particular to ferritic Cr-Mo steels, the ductility values determined by notched impact tests are reported in the following with reference to two Examples using steels with the preferred composition according to the invention and, for comparison, conventional steels.

Steels A and C have the composition according to the invention.

| | EXAMPLE I | | EXAMPLE II | |
|---|---|---|---|---|
| | Steel A | Steel B | Steel C | Steel D |
| C | 0.012 | 0.011 | 0.014 | 0.012 |
| Si | 0.4 | 0.35 | 0.41 | 0.32 |
| Mn | 0.32 | 0.28 | 0.39 | 0.33 |
| Cr | 25.7 | 25.3 | 21.1 | 21.2 |
| Ni | 4.20 | 0.10 | 3.5 | 0.4 |
| Mo | 4.08 | 3.1 | 3.2 | 3.1 |
| Ti | 0.45 | 0.41 | 0.39 | 0.35 |
| Cu | 0.55 | 0.010 | 0.38 | 0.45 |
| Al | 0.059 | 0.049 | 0.048 | 0.05 |
| Nb | 0.011 | 0.021 | | |
| $N_2$ | 0.015 | 0.010 | 0.010 | 0.010 |

Figure 2:
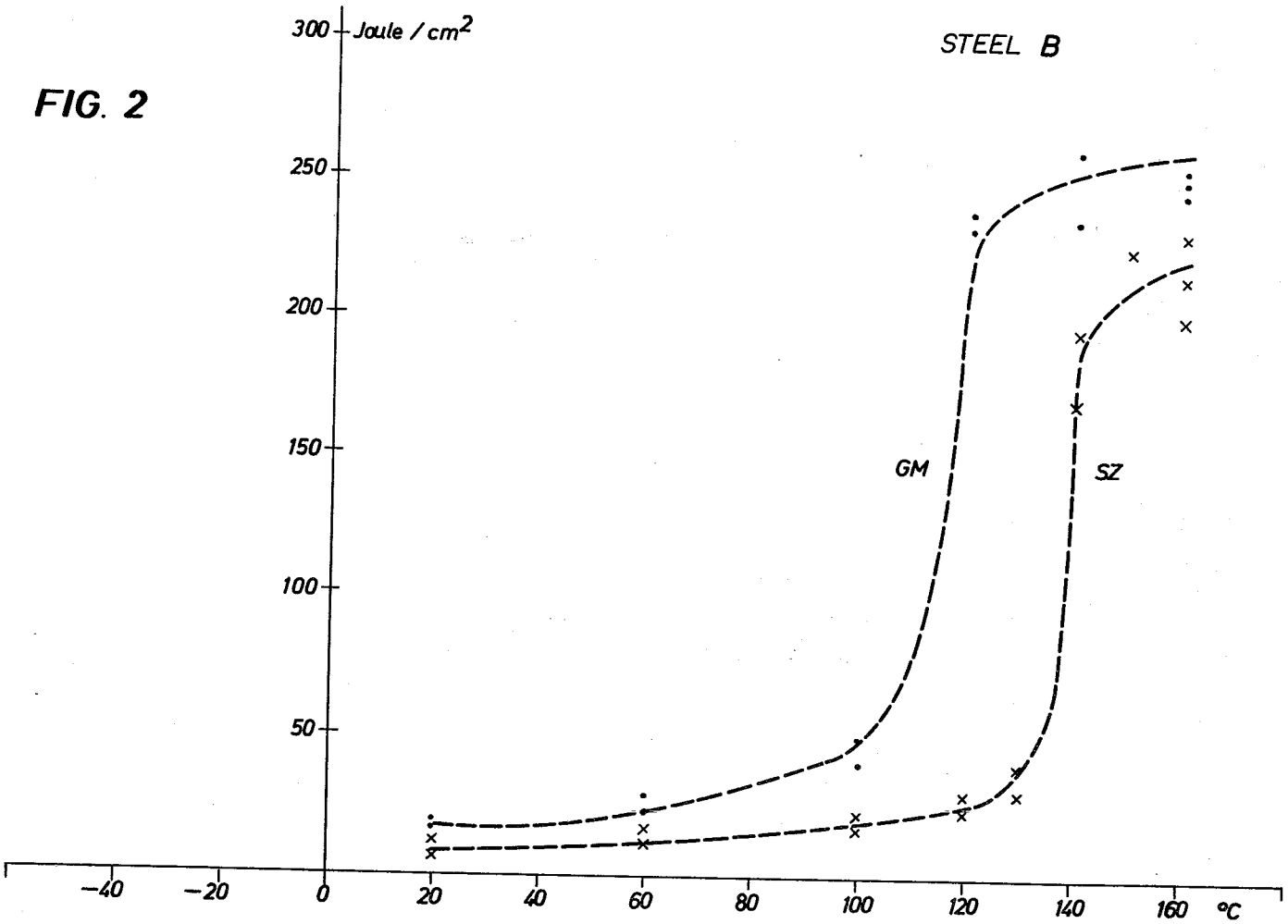
Figure 3:
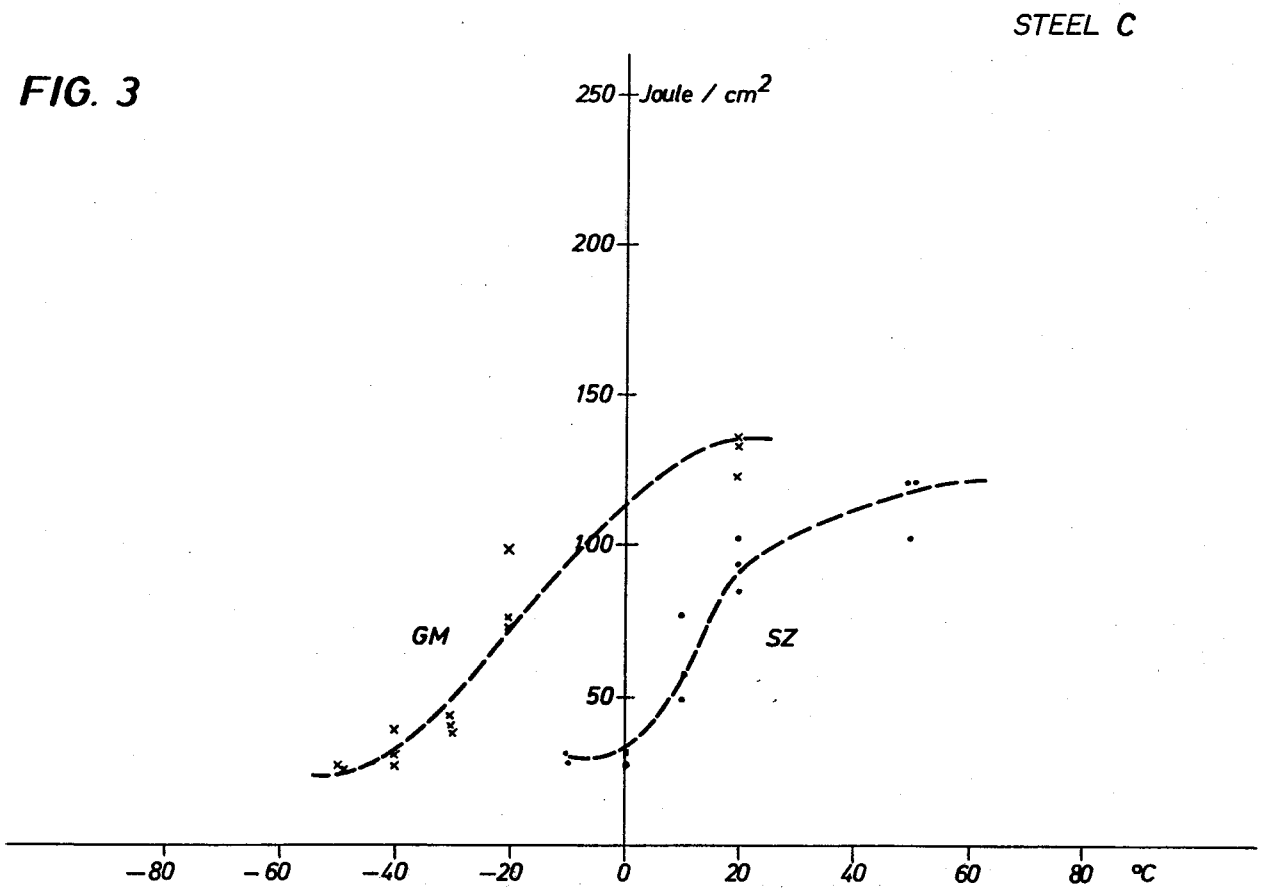
Figure 4:
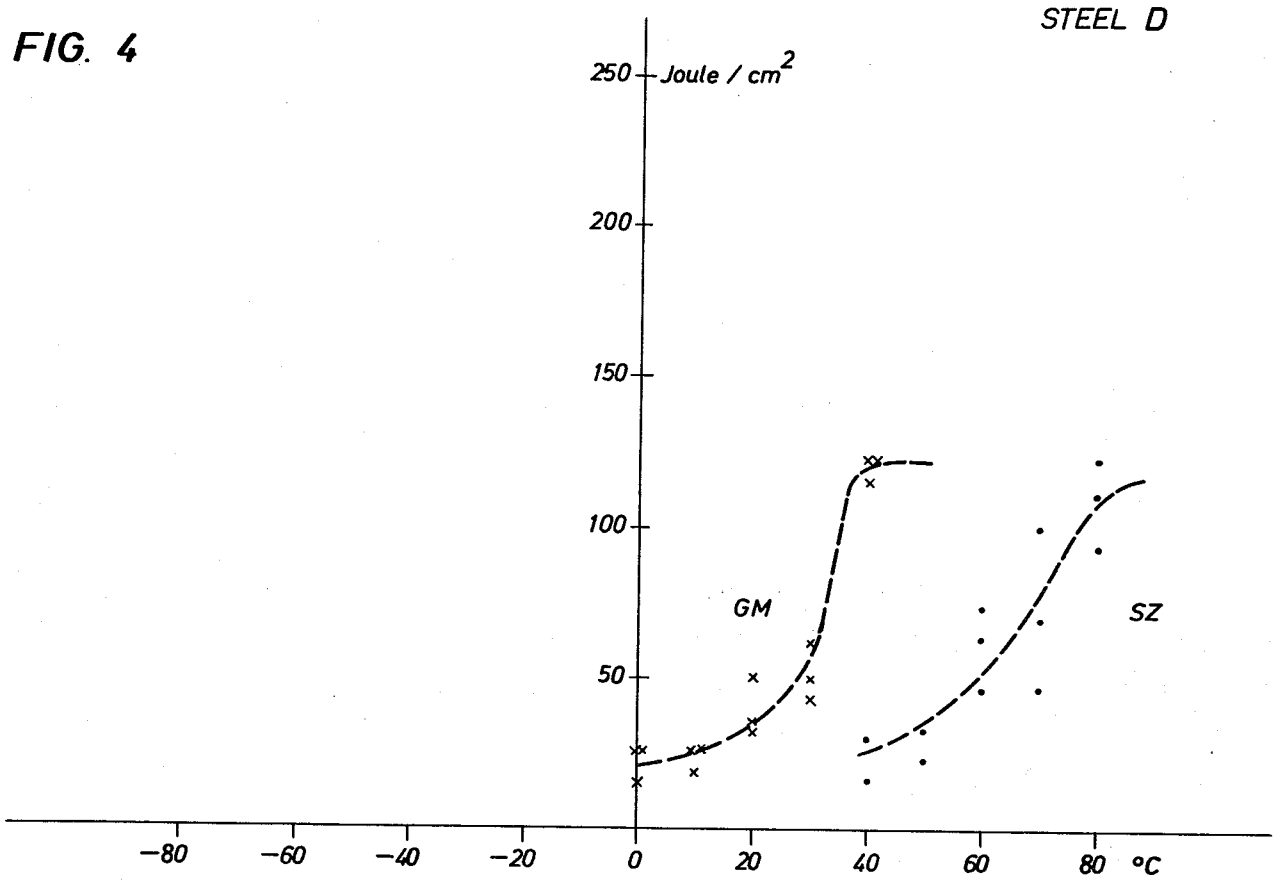

The ductility values of steels A, B, C and D are shown in the form of graphs in FIGS. 1, 2, 3 and 4, respectively.

The curves "GM" relate to the base material whilst the curves "SZ" relate to the zones adjacent the weld seam which are particularly exposed to the influence of the welding temperature in terms of embrittlement.

Comparison of the curves "GM" of the two steels A and B shows that the transition temperature of the steel A according to the invention lies between −60° C. and −80° C. whereas the conventional steel B has a transition temperature which lies between +80° C. and +100° C. Comparison of the curves "SZ" shows a transition temperature for the steel A according to the invention of from −40° C. to −20° C. and, for the comparison steel B, a transition temperature of from +120° C. to +140° C. The curve "GM" for steel C shows a transition temperature in the range from −30° C. to −50° C. For steel D, the characteristic values are in the range from +10° C. to +30° C. Comparison of the curves "SZ" shows a transition temperature for steel C according to the invention of from −10° C. to ±0° C. and, for the comparison steel D, a transition temperature of from +40° C. to +50° C.

So far as the expert is concerned, these results show that steels, particularly sheet steels, according to the invention is welded constructions do not become brittle at room temperature or at temperatures below room temperature.

It is also clear to the expert that the additions of nickel and copper have to be selected in such a way that, for optimum ductility, there is little or no reduction in the resistance to stress-corrosion which would be the case for example if additions above the upper limits for Ni and Cu according to the invention were to be made, for example 5.0% for Ni and 2.0% for Cu.

The necessary degree of invention is embodied in the specified limits of the various alloying ranges, particularly for Ni and Cu.

So far as the $C+N_2$-content is concerned, it is pointed out that the contents prescribed in accordance with the invention, namely a relatively high $(C+N_2)$-content guarantee the reproducibility of the steels which is not the case when the $(C+N_2)$-content is less than 0.015% and when the objective is for the sum of $(C+N_2)$ not to exceed 0.01%. In addition, reproducibility is facilitated by the nickel content according to the invention whereby even fairly large fluctuations in the $C+N_2$ content have no effect upon the ductility of the steel.

We claim:

1. Ferritic, stabilized, corrosion-resistant and ductile chromium-molybdenum-nickel steels having a ductile area at the weld seam, consisting essentially of 0.012–0.025% Carbon, 0.02–0.5% Silicon, 0.02–0.5% Manganese, 20.0–22.0% Chromium, 3.2–3.5% Nickel, 3.0–4.5% Molybdenum, 0.2–0.5% Copper, $0.2+4x(C+N_2)$, but at most 0.7 Titanium and/or $0.2+8x(C+N_2)$, but at most 1.0% Columbium, 0.005 to 0.015% Nitrogen, The balance essentially iron.

2. Ferritic, stabilized, corrosion-resistant and ductile chromium-molybdenum-nickel steels having a ductile area at the weld seam consisting essentially of 0.012–0.025% Carbon, 0.02–0.5% Silicon, 0.02–0.5% Manganese, 24.5–27.0% Chromium, 3.5–4.2% Nickel, 3.7–4.5% Molybdenum, 0.2–0.5% Copper, $0.2+4x(C+N_2)$, but at most 0.7% Titanium or $0.4+8x(C+N_2)$, but at most 1.0% Columbium, 0.005 to 0.015% Nitrogen The balance essentially iron.

* * * * *